US010927575B2

(12) United States Patent
Binzer

(10) Patent No.: US 10,927,575 B2
(45) Date of Patent: Feb. 23, 2021

(54) FIREPLACE LATCH SYSTEM

(71) Applicant: CANADIAN HEATING PRODUCTS INC., Langley (CA)

(72) Inventor: Lothar Dan Binzer, Surrey (CA)

(73) Assignee: CANADIAN HEATING PRODUCTS INC., Langley (CA)

( * ) Notice: Subject to any disclaimer, the term of this patent is extended or adjusted under 35 U.S.C. 154(b) by 464 days.

(21) Appl. No.: 15/804,461

(22) Filed: Nov. 6, 2017

(65) Prior Publication Data

US 2018/0245386 A1 Aug. 30, 2018

(30) Foreign Application Priority Data

Feb. 24, 2017 (CA) ..... CA 2958977

(51) Int. Cl.
*E05C 19/06* (2006.01)
*E05B 65/00* (2006.01)
(Continued)

(52) U.S. Cl.
CPC ..... *E05C 19/06* (2013.01); *E05B 65/006* (2013.01); *E05C 3/008* (2013.01); *E05C 3/048* (2013.01)

(58) Field of Classification Search
CPC ..... Y10T 292/0862; Y10T 292/0911; Y10T 292/0921; Y10T 292/0925; Y10T 292/0926; Y10T 292/0934; Y10T 292/0951; Y10T 292/0952; Y10T 292/0959; Y10T 292/1049; Y10T 292/1061; Y10T 292/1051; Y10T 292/1083; Y10T 292/1084; Y10T 292/1085; Y10T 292/1092; Y10T 292/082; Y10T 292/0813; Y10T 292/081;
(Continued)

(56) References Cited

U.S. PATENT DOCUMENTS 683,889 A * 10/1901 Booth et al. ..... E05C 17/50 292/121
927,240 A 7/1909 Hoffman
(Continued)

FOREIGN PATENT DOCUMENTS

DE 202016103637 U1 9/2016

OTHER PUBLICATIONS

Heatilator, Owner's Manual for Model Nos. CRAVE 4836, CRAVE 4836ST, CRAVE 6048, CRAVE 6048ST, CRAVE 7260, CRAVE 7260ST, CRAVE 8472, and CRAVE 8472ST, Fixed Glass Assembly, published 2016 or earlier. (Excerpt).
(Continued)

*Primary Examiner* — Alyson M Merlino
(74) *Attorney, Agent, or Firm* — Greer, Burns & Crain, Ltd.

(57) ABSTRACT

A fireplace latch system has a pivotable latch retained within a latch retainer. One or more springs between the pivotable latch and latch retainer bias the latch towards two stable positions, an opened position and a closed position. In the closed position, one or more surface contacting elements extend through the latch retainer and exert a force on a frame for a glass panel to secure the glass panel and frame to the fireplace. The latch system allows the glass panel and frame to move outwards to release pressure in the event of an explosion within the combustion chamber of the fireplace.

7 Claims, 4 Drawing Sheets

(51) Int. Cl.
*E05C 3/04* (2006.01)
*E05C 3/00* (2006.01)

(58) Field of Classification Search
CPC ..... Y10T 292/0825; Y10T 292/0833; Y10T 292/0894; Y10T 292/0902; Y10T 292/0905; Y10T 292/0907; Y10T 292/0936; Y10T 292/1062; E05C 3/006; E05C 3/008; E05C 3/04; E05C 3/047; E05C 3/048; E05C 19/06; E05C 65/006; E05B 65/006
See application file for complete search history.

(56) References Cited

U.S. PATENT DOCUMENTS 2,859,744 A * 11/1958 Hadley ..... E05C 3/14 126/197
3,099,471 A 7/1963 Scott et al.
3,220,759 A * 11/1965 Miller ..... E05C 3/14 292/120
3,347,580 A * 10/1967 Whiting ..... E05B 65/0811 292/128
4,068,874 A * 1/1978 Fleming ..... E05B 65/0811 292/128
4,952,160 A * 8/1990 Olsen ..... B63B 17/00 439/142
5,471,973 A 12/1995 Wilhoite
5,613,487 A 3/1997 Hawkinson
5,782,231 A 7/1998 Wade
5,823,644 A * 10/1998 Suh ..... G06F 1/181 312/223.2
6,138,667 A * 10/2000 Cakebread ..... F24C 3/004 126/512
6,373,692 B1 * 4/2002 Cheng ..... G06F 1/181 220/4.02
6,612,625 B1 * 9/2003 Barber ..... E05C 19/06 220/326
7,077,122 B2 7/2006 Lyons et al.
7,097,214 B2 * 8/2006 Tsai ..... E05B 65/0864 292/156
7,611,174 B2 11/2009 Lau et al.
8,016,328 B2 * 9/2011 Sans Rovira ..... F16P 3/08 292/96
2004/0149279 A1 8/2004 Erickson
2004/0195841 A1 * 10/2004 Liu ..... E05C 5/00 292/24
2007/0290511 A1 * 12/2007 Liang ..... E05B 65/0858 292/24
2008/0129054 A1 * 6/2008 Tremble ..... E05B 65/08 292/33
2009/0070971 A1 * 3/2009 Kamada ..... A63F 13/02 24/495
2009/0134639 A1 * 5/2009 Ramsauer ..... E05C 3/30 292/226
2012/0102840 A1 * 5/2012 Chen ..... E05B 65/0811 49/449

OTHER PUBLICATIONS

Marquis, Owner's Manual for Model Nos. MQRB4436N, MQRB4436NE, MQRB4436LP, MQRB4436LPE, MQRB5143N, MQRB5143NE, MQRB5143LP, MQRB5143LPE, MQRB6961 N, MQRB6961NE, MQRB6961LP and MQRB6961LPE, Infinite Series, Door Latch Tool, published 2016 or earlier. (Excerpt).
Napoleon, Owner's Manual for Model Nos. BGD36CFNTR, BGD36CFNTRE, BGD36CFPTR, BGD36CFPTRE, LHD45N and LHD45 P, Natural Gas Model, Propane Gas Model, published 2016 or earlier. (Excerpt).
Regency, Owner's Manual for Model No. BELLAVISTA® B36XTE, Gas Fireplace, published May 5, 2014. (Excerpt).
Savannah, Owner's Manual for Model No. SUMMIT65, Door Installation, published 2016 or earlier. (Excerpt).
Town & Country, Owner's Manual for Model No. TC30—Series D, Modular Direct Vent Fireplace, Door Frame Removal, published 2016 or earlier (Excerpt).
Heat & Glo, Owner's Manual for Model Nos. 6000CLX-IPI-S, 6000CLX-IPI-T, 8000CLX-S and 8000CLX-IPI-T, Fixed Glass Assembly, Install Trim and/or Surround, Air Shutter Setting, p. 66, published 2016 or earlier (Excerpt).
Valor, Owner's Manual for Model Nos. 1800JN (NG) and 1800JP (LPG), DV ZC Gas Fireplace, published 2016 or earlier (Excerpt).

* cited by examiner

FIREPLACE LATCH SYSTEM

BACKGROUND

The present invention relates to a fireplace window/door latch system. In particular, the invention relates to a fireplace latch system that permits the outwards movement of a glass panel during an explosion.

Gas fireplaces are now commonplace in homes and commercial spaces including restaurants, hotels, and shopping centres. One or more glass panels are normally sealed around the combustion chamber to allow people to view the fire.

A safety concern associated with gas fireplaces is the risk of an explosion. If the fireplace malfunctions, high levels of gas may accumulate within the combustion chamber. If such levels of gas are then ignited, an explosion can occur potentially causing damage and injury. For instance, in 2012 the British Columbia Safety Authority issued a Safety Order in relation to a fireplace that expelled glass causing injury because of a delayed ignition. Fireplace regulations and standards in various jurisdictions require some form of pressure relief device to prevent such explosions and injury.

One known way addressing such a safety concern is to provide a latch system that allows for some outward movement of a glass panel in the event of an explosion. For instance, U.S. Patent Application Publication No. 2004/0149279 to Erickson discloses a latch system having a spring that extends over a rod. However, the Erickson latch system is difficult to install correctly since some components are anchored to a wall of the combustion chamber and other components are connected to a frame that holds the glass panel.

It is therefore an object of this invention to provide an easy to install fireplace latch system that permits a glass panel to move outwards and release pressure in the event of an explosion.

It is a further object of the invention to provide fireplace latch system that enables a user to quickly and easily remove a glass panel from a fireplace to permit the service or inspection of components within the combustion chamber.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY

In one aspect, the invention is a fireplace latch system having a pivotable latch within a latch retainer. One or more springs between the pivotable latch and the latch retainer biases the latch system towards opened and closed positions. In the opened position, hooks connected to the pivotable latch extend through apertures in the latch retainer and exert a retaining force upon the fireplace window/door. In the closed position, the hooks are retracted within the latch retainer and allow the fireplace window/door to be removed.

In another aspect of the invention, a fireplace latch system comprises a retainer, a latch, and one or more springs. The retainer comprises a first retainer wall and a second retainer wall. The first retainer wall has one or more apertures for one or more abutments the second retainer wall has an aperture for a tongue latch. The second container wall is connected to the first retainer wall such that the first and second retainer walls are at acute angles to one another. The latch comprises a first latch portion, a second latch portion, a latch tongue, and one or more abutment members. The first latch portion has a first end and a second end. The second latch portion is connected to the first latch portion at the first end. The latch tongue is connected to the first latch portion at the second end and the latch tongue extends through the aperture of the second retainer wall. The one or more abutment members are connected to the first latch portion at the second end. The one or more springs have a first end connected to the second retainer wall and a second end connected to the second latch portion.

In a further aspect, the fireplace latch system is pivotally moveable between a closed position and an opened position. In the closed position, the one or more abutment members extend through the one or more apertures of the first retainer wall and the first retainer wall is parallel to the first latch portion. In the opened position, the one or more abutment members do not extend though the one or more apertures of the first retainer wall and the second retainer wall is at an angle to the first latch wall.

In a further aspect, the fireplace latch system has two springs, the latch has two abutment members, and the first retainer wall has two apertures for the two abutment members.

In yet a further aspect, the latch tongue has an aperture.

In another aspect, the fireplace latch system further comprises a third retainer wall connected to the first retainer wall at an end of the first retainer wall that is opposite to the connection between the first retainer wall and the second retainer wall.

In another aspect, the third retainer wall is perpendicular to the first retainer wall.

In another aspect, the third retainer wall has apertures for screws.

In another aspect of the invention, a fireplace latch assembly comprises a pivotable latch retained within a latch retainer and a spring interposed between the latch and the retainer. The latch has a first position in which at least one surface contacting element of the latch extends through the latch retainer to exert a force on a surface associated with a window of the fireplace, and a second position in which the at least one surface contacting element does not exert a force on the surface associated with the window. The spring biases the latch towards the first position when the latch is in the first position and the spring biases the latch towards the second position when the latch is in the second position.

In another aspect, when the latch is in the first position, a surface of the latch is in coplanar abutment with a surface of the retainer and one end of the spring is secured to a portion of the retainer that is at an acute angle with respect to the coplanar abutment.

In another aspect, a first end of the spring is mounted on a portion of the retainer and a second end of the spring is mounted on a portion of the latch.

In a further aspect, the spring is a coil spring tending to have a straight longitudinal axis when unstressed. The first end is mounted to the portion of the retainer such that if the second end were unattached and unstressed, the longitudinal axis would extend between where the portion of the latch lies in the first position and where the portion of the latch lies in the second position. The spring twists off the longitudinal axis in a first direction in the first position of the latch and twists off the longitudinal axis in a second, opposed, direction in the second position of the latch.

The foregoing may cover only some of the aspects of the invention. Other aspects of the invention may be appreciated by reference to the following description of at least one preferred mode for carrying out the invention in terms of one or more examples.

The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION

Figure 1:
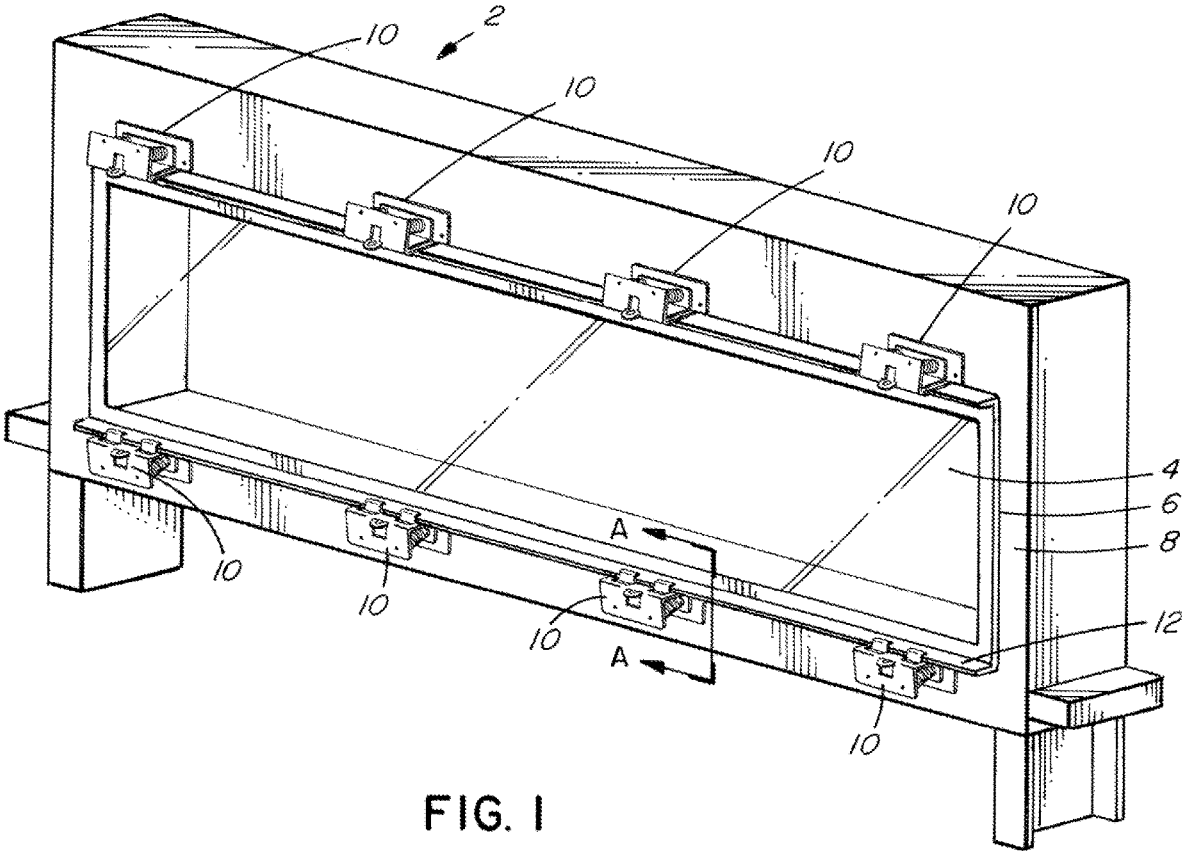
FIG. 1 is a perspective view of a gas fireplace having the latch systems according to one embodiment of the invention.

FIG. 1 shows a gas fireplace 2 having a glass panel 4. The glass panel 4 is held within a frame 6 that is secured to a front wall 8 of the fireplace 2 by several latch systems 10 according to one embodiment of the invention.

Figure 4:
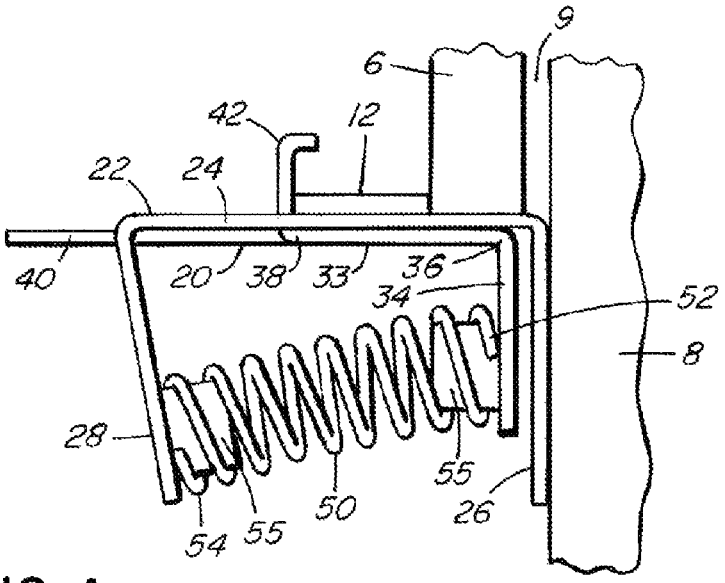
FIG. 4 is a cross-sectional view taken along line A-A of FIG. 1 showing the latch system in a closed position.
Figure 5:
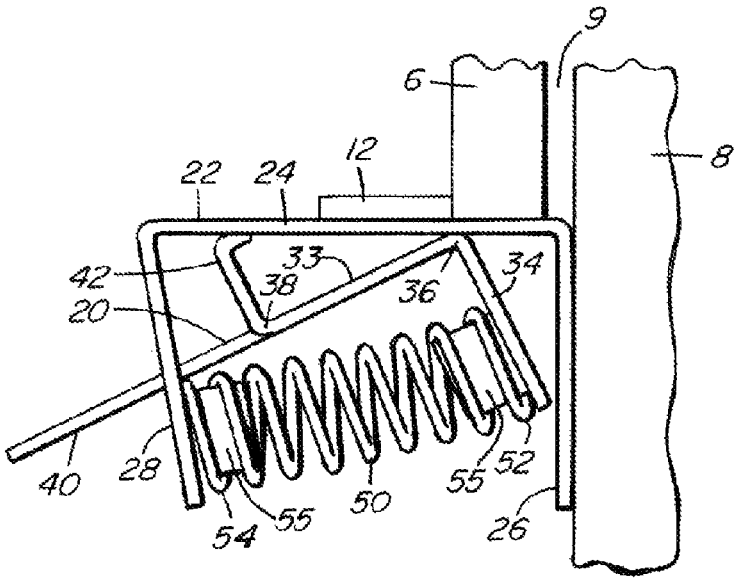
FIG. 5 is a cross-sectional view that corresponds to the view shown in FIG. 4 but showing the latch system in an opened position.

As best shown in FIGS. 4 and 5, latch systems 10 are coupled to a fireplace frame 6 having an outwardly extending lip 12 at its base. The top of the frame 6 has a corresponding lip for latch systems 10 used to secure the top of the frame 6. It is contemplated that the latch system 10 of the invention can also be used in association with a hole in the frame rather than a lip. Alternately, the latch system may be used with a fireplace frame lacking a lip or holes in which case the latch system could bear directly on a flat surface of the frame.

Gap 9 shown in FIGS. 4 and 5 is illustrated to signify that the frame 6 is not secured to the front wall 8 of the fireplace except by the latch systems 10. In practice, there may be a seal or cushion between frame 6 and the front wall 8 of the fireplace. Alternatively, if seals and cushions are not used, the frame 6 may be pressed directly against the front wall 8 of the fireplace in which case there would be no gap 9.

The latch system 10 has a latch 20 pivotable within a retainer 22. Retainer 22 has three walls 24, 26, 28 that together generally form a U-shaped structure. Retainer wall 26 is connected to one end of middle retainer wall 24 and retainer wall 28 is connected to the opposite end of middle retainer wall 24. Retainer walls 24 and 28 are at acute angles to one another whereas retainer wall 24 and 26 are perpendicular or substantially perpendicular to one another.

Figure 2:
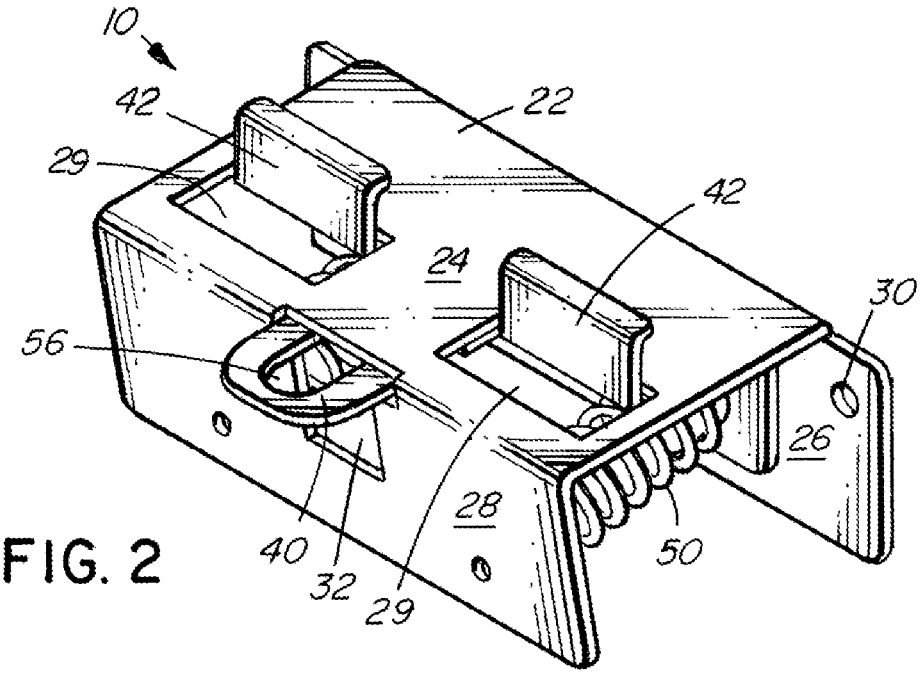
FIG. 2 is a perspective view of one of the latch systems shown in FIG. 1 in a closed position.
Figure 3:
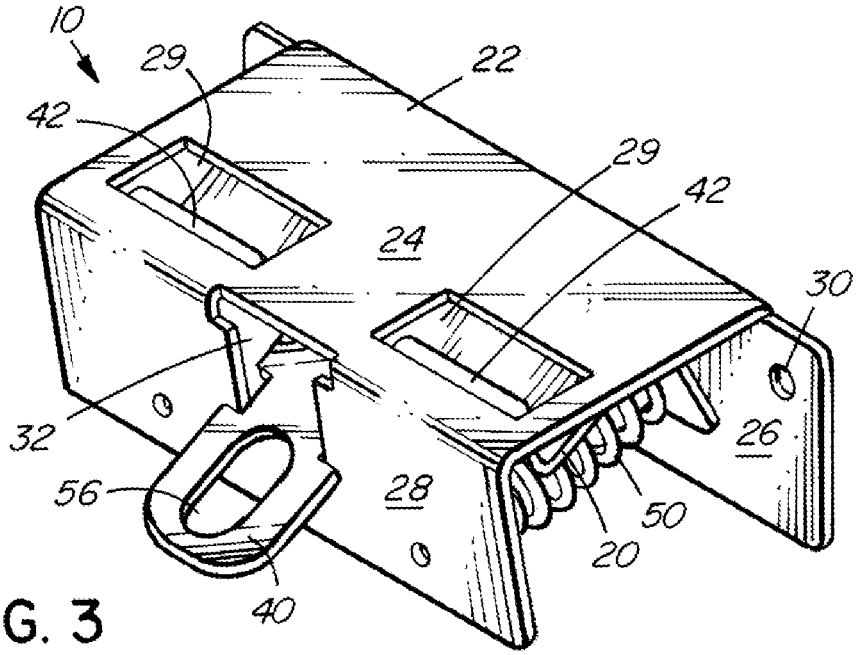
FIG. 3 is a perspective view of one of the latch systems shown in FIG. 1 in an opened position.

Now referring to FIGS. 2 and 3, the middle retainer wall 24 has one or more apertures 29. Retainer wall 26 may be secured to the front wall or combustion chamber of the fireplace by means of screws through one or more screw holes 30 on the retainer wall 26. Retainer wall 28 has an aperture 32 that is preferably located near the edge or bend between retainer walls 24 and 28. Note that frame 6 abuts middle retainer wall 24 but is not otherwise secured to it.

Figure 7:
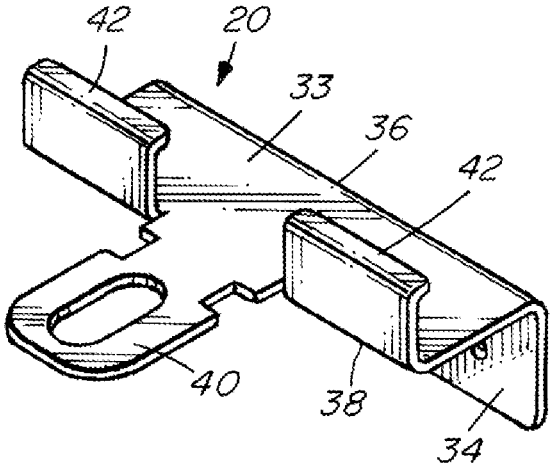
FIG. 7 is an isolated front perspective view of the latch portion of the latch system shown in FIGS. 2 to 5.
Figure 8:
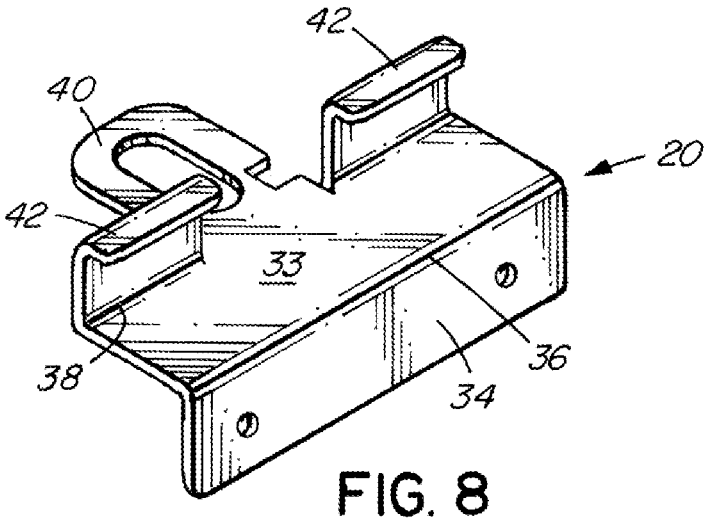
FIG. 8 is an isolated rear perspective view of the latch portion of the latch system shown in FIGS. 2 to 5.

Referring to FIGS. 7 and 8, pivotable latch 20 has a first portion 33 attached to a second portion 34, preferably by a perpendicular bend at end 36 of first portion 33. At the opposing end 38 of first portion 33, a central latch tongue 40 extends away from first portion 33 in a direction away from end 36. The central latch tongue 40 extends through aperture 32 of retainer wall 28 (as shown in FIGS. 2 and 3). End 38 also has two abutment members that are connected at or near the end 38 preferably by perpendicular or substantially perpendicular bends. While the abutment members are shown as being hooks 42, other shapes and structures are possible. When the latch system is in the closed position, as shown in FIGS. 2 and 4, the hooks 42 extend through apertures 29 in retainer wall 24. In the opened position, hooks 42 lie within the U-shaped retainer 22 and do not pass through apertures 29.

The pivoting of latch 20 within retainer 22 is enabled by one or more springs 50. Springs 50 also function to keep the latch 20 within retainer 22. In the preferred embodiment, two springs 50 are used. One end 54 of each spring is connected to retainer wall 28 and the opposing end 52 is connected to second portion 34 of latch 22. The springs 50 may be connected to the retainer wall 28 and to the second portion 34 of latch 22 using spacers 55.

As a result of the acute angle between retainer wall 28 and middle retainer wall 24, the springs 50 will naturally bias the latch system 10 towards two stable states, namely a closed state as shown in FIGS. 2 and 4 and an opened state as shown in FIGS. 3 and 5. To move the latch system between the two stable states, a user pulls the latch tongue outwards (i.e. away from the fireplace) and manipulates the tongue either upwards or downwards towards the desired position. Once the tongue 40 is released, the latch 20 will automatically snap to either the closed or opened position. Tongue 40 may also have an aperture 56 into which a user can insert a rod-shaped tool, such as a screwdriver, to assist with pulling the tongue 40 outwards. The latch system 10 therefore enables a user to quickly and easily remove or install a glass panel 4 and frame 6.

Referring to the closed state shown in FIG. 4, the first portion 33 of the pivotable latch 20 is in coplanar abutment with the middle retainer wall 24 of the retainer 22. End 54 of each spring 50 is secured to a retainer wall 28 that is at an acute angle with respect to the coplanar abutment of the first portion 33 and middle retainer wall 24.

Springs 50 are preferably coil springs tending to have a straight longitudinal axis when unstressed. End 54 of each spring 50 is mounted to the acutely-angled retainer wall 28 such that if the opposing end 52 were unattached and unstressed, the longitudinal axis of the spring would naturally extend toward a point located between where the attachment point of the spring to the second portion 34 of the pivotable latch 20 lies in the closed state (as shown in FIG. 4) and where it lies in the opened state (as shown in FIG. 5). The closed and open states of the latch therefore represent opposed positions of the spring that are slightly off-axis as compared to the naturally stable unstressed axis of the spring. Springs 50 twist off the longitudinal axis in one direction in the closed state and twist off the longitudinal axis in a second, opposite direction in the opened state to hold the latch in the closed and open states respectively. The spring remains constrained in those otherwise unstable positions by the presence of the retainer wall 28 and the retention of the latch 20 within the retainer 22.

Referring again to FIG. 4, in the closed position springs 50 cause the hooks 42 to exert a force against lip 12 of frame 6. In the event of an explosion within the combustion chamber of the fireplace, springs 50 will compress and permit the frame 6 and glass panel 4 to move outwards. This relieves the high pressure caused by the explosion and the chances that the glass panel 4 will shatter and cause injury and damage to persons and property in the vicinity.

As indicated earlier, the latch system could be used in association with a frame having holes rather than lips. In such an arrangement, the latch system is installed on a fireplace such that the hooks of the latch system extend through the holes in the frame when the latch system is in the closed position.

It is also contemplated that the latch system may be used in association with a fireplace window not enclosed within a frame. In such case, the window itself may have a lip or holes for receiving the latch system's hooks. Alternatively, the latch system may bear directly on the surface of the window. The hooks could have a cushion or be covered in a protective material to prevent the scratching of the window.

Figure 6:
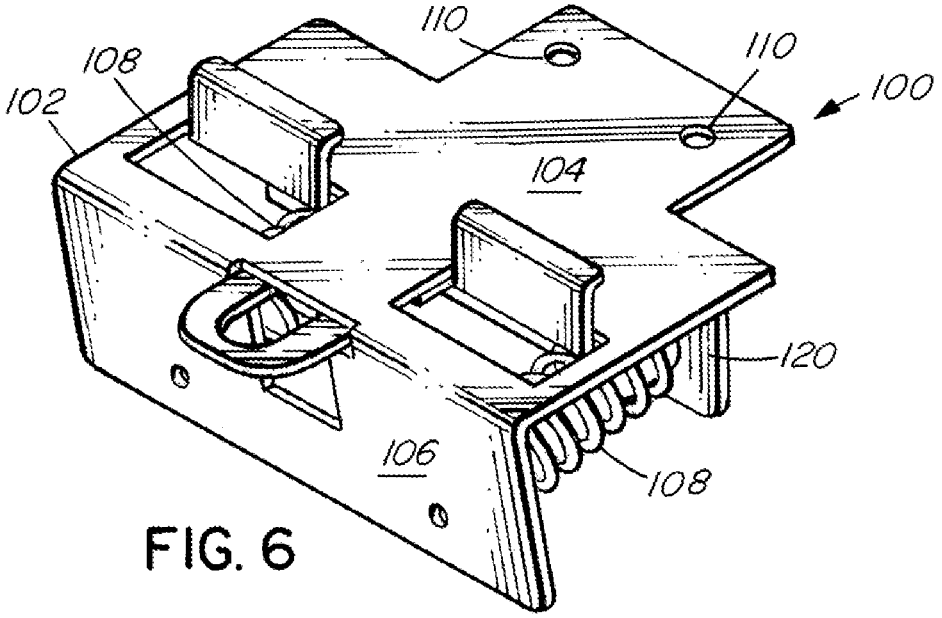
FIG. 6 is a perspective view of a latch system according to an alternate embodiment of the invention.

FIG. 6 shows latch system 100 according to an alternate embodiment. The latch system 100 is shown in a closed position. Retainer 102 of latch system 100 has two retainer walls 104, 106 that together generally from a L-shaped structure rather than the U-shaped structure of the retainer 22 shown in FIGS. 2 to 5 having three retainer walls. Retainer walls 104, 106 of latch system 100 are at acute angles to one another such that springs 108 bias the latch system towards a stable closed position and a stable opened position. Latch system 100 may be secured to the fireplace by means of screws through screw holes 110 in retainer wall 104. The latch 120 of the latch system 100 may be the same as the latch 20 shown in FIGS. 7 and 8.

It will be appreciated that the latch systems of the present invention may be attached to newly manufactured fireplaces or retrofitted on existing fireplaces.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

What is claimed is:

1. A fireplace latch system comprising:

a retainer comprising:

a first retainer wall having one or more apertures for one or more abutment members of a latch; and a second retainer wall having an aperture for a latch tongue of said latch, said second retainer wall being connected to said first retainer wall such that said first and second retainer walls are at an acute angle to one another;

said latch comprising:

a substantially planar first latch portion extending in a first plane and having a first end and a second end;

a substantially planar second latch portion extending in a second plane and directly connected to said first latch portion at said first end, wherein said first plane is substantially perpendicular to said second plane;

said latch tongue directly connected to said first latch portion at said second end, said latch tongue extending through said aperture of said second retainer wall; and said one or more abutment members directly connected to said first latch portion at said second end; and one or more springs having a first end directly connected to said second retainer wall and a second end directly connected to said second latch portion.

2. The fireplace latch system of claim 1 wherein said latch is pivotally moveable between a closed position and an opened position;

wherein in said closed position, said one or more abutment members extend through said one or more apertures of said first retainer wall, and said first retainer wall is parallel to said first latch portion; and wherein in said opened position, said one or more abutment members do not extend through said one or more apertures of said first retainer wall, and said second retainer wall is at an angle to said first latch portion.

3. The fireplace latch system of claim 1 wherein said one or more springs comprises two springs, said one or more abutment members comprises two abutment members, and said one or more apertures of said first retainer wall comprises two apertures for said two abutment members.

4. The fireplace latch system of claim 1 wherein said latch tongue has an aperture.

5. The fireplace latch system of claim 1 wherein said retainer comprises a third retainer wall connected to said first retainer wall at an end of the first retainer wall that is opposite to the connection between the first retainer wall and the second retainer wall.

6. The fireplace latch system of claim 5 wherein said third retainer wall is perpendicular to said first retainer wall.

7. The fireplace latch system of claim 5 wherein said third retainer wall has apertures for screws.

* * * * *